US007553041B1

(12) United States Patent
Terhune

(10) Patent No.: US 7,553,041 B1
(45) Date of Patent: Jun. 30, 2009

(54) FLOATING LUMINARY DEVICE

(76) Inventor: Diane D. Terhune, 74 Old Chester Rd., Essex Fells, NJ (US) 07021

( * ) Notice: Subject to any disclaimer, the term of this patent is extended or adjusted under 35 U.S.C. 154(b) by 0 days.

(21) Appl. No.: 12/011,118

(22) Filed: Jan. 24, 2008

(51) Int. Cl.
*F21V 33/00* (2006.01)

(52) U.S. Cl. ..... 362/101; 362/161; 362/179

(58) Field of Classification Search ..... 362/101, 362/158, 161, 171, 172, 179, 181, 267; 431/289, 431/291, 294, 295, 298, 343
See application file for complete search history.

(56) References Cited

U.S. PATENT DOCUMENTS 585,756 A * 7/1897 Hertzler ..... 362/161
1,391,353 A * 9/1921 Wells ..... 47/71
2,234,903 A 3/1941 Muench
2,330,705 A 9/1943 Hamblet
2,465,684 A * 3/1949 Heintze ..... 431/295
2,876,587 A * 3/1959 Saks et al. ..... 362/161
4,524,408 A 6/1985 Minera
4,588,618 A 5/1986 Wolfe
4,937,701 A 6/1990 Schroder
5,927,959 A * 7/1999 Johnson ..... 431/289
6,092,772 A 7/2000 Garcia et al.
6,579,089 B1 6/2003 Iu

* cited by examiner

*Primary Examiner*—Y My Quach Lee
(74) *Attorney, Agent, or Firm*—Kenneth P. Glynn; Deirdra M. Meagher

(57) ABSTRACT

The present invention is directed to a floating luminary device that includes: (a.) a base saucer having at least one closed air chamber for floatation, the base saucer having a first predetermined maximum width; and, (b.) a candle mantle located on the base saucer and projecting upwardly from the base saucer and having sufficient space therein for encompassing a candle, the candle mantle having a second predetermined maximum width wherein the first predetermined maximum width is at least 10% greater than the second predetermined maximum width.

20 Claims, 6 Drawing Sheets

FLOATING LUMINARY DEVICE

BACKGROUND OF INVENTION a. Field of Invention

The invention relates generally to floating luminary devices, and, particularly, floating luminary devices that have wide base saucers containing floatation air chambers. They are preferably designer quality devices that safely hold one or more candles.

b. Description of Related Art

The following patents are representative of floating devices with candles or lights:

U.S. Pat. No. 6,579,089 B1 to Iu describes a floating candle holder which is provided that includes: an anchor portion formed of a material having a density greater than that of water; a candle having a wick, the candle positioned above the anchor portion; and a shield portion having an opening defined in the top thereof for changing the candle, the shield portion positioned above the anchor portion, about the candle, and extending above the top of the wick of the candle by an amount that is at least 0.7 times as high as the largest horizontal internal dimension of the opening defined in the top of the shield portion. The anchor portion and shield portion are adapted to float the candle on water. The water line of the floating candle holder is within the bottom two-thirds of the overall height of the floating candle holder, and the center of gravity is below the water line, whereby the location of the center of gravity below the water line helps stabilize the floating candle holder against being capsized by winds. The shield portion protects the flame of the lit candle from the water and wind. At least a portion of the shield portion that is above the water line is at least partially transparent to candlelight. Thus, a floating candle holder is provided that better protects the flame of the candle from the wind, enabling the floating candle holder to be used outdoors.

U.S. Pat. No. 6,092,772 to Garcia et al. describes a device which is provided for supporting an accessory in an artificial bathing water enclosure. The device includes a buoyant base for supporting the accessory. An anchoring means anchors the base to a side wall of the bathing water enclosure. The base either floats freely, or is pulled down somewhat while still protruding from the top water surface. The preferred anchoring means includes one or more suction cups attached to the side walls of the enclosure. The preferred anchoring means maintains the base upright. It includes a boss and a holder that are slidable with respect to each other. At least two suction cups hold the boss attached to the side wall, while the holder is attached to the base, and slides up and down as the base moves up and down. The holder has threads for receiving matingly threads of a complementary base.

U.S. Pat. No. 4,937,701 to Schroder describes a safety device for burning candles including an outer vessel that holds a supply of water, an inner reflector container that holds a small quantity of water, and a reversible footed candle holder that can be selectively positioned within the reflector to support candles of different sizes. The device provides cooling for the sidewall and base of the reflector to minimize the fire hazard associated with burning candles. One end of the reversible holder accommodates a candle while the other end provides a recess which is filled with cooling water to control the high heat level present when the candle burns to the bottom. An insert candle holder is also provided to allow the burning of small birthday-type candles.

U.S. Pat. No. 4,588,618 to Wolfe describes an ornamental floating apparatus for use in a swimming pool comprises a first buoyant body, preferably in the form of a water lily, and a second, nonbuoyant body, which is below the first body and supported by it so that it is stable, moving about a horizontal axis when the first body moves about a horizontal axis, as due to agitation of the water in the swimming pool. The second body may be connected either by a substantially rigid post, or by a pair of flexible strands, preferably monofilament. The second bodies are in the form of fishes, relatively large fishes being supported by the flexible strands, and relatively smaller fishes being supported by the posts. The ornamental body is preferably in the form of a water lily, and has a plurality of petal-simulating elements thereon, with a cup in the center of the elements for supporting a candle, the cup having a stem extending through holes in the elements and into the body.

U.S. Pat. No. 4,524,408 to Minera describes an improved combination for use in burning an elongated candle floating in water. The improved combination comprises a float member including a passageway at least one inch long dimensioned to receive the cross-section of the candle with a sliding fit. Various structures for stabilizing the float member in the water with the passageway in a substantially vertical position and the upper end thereof at the surface of the water are disclosed. Containers of water of limited volume for use in the improved combination are described. Float members including chimneys and a preferred candle structure for use in the improved combination are described.

U.S. Pat. No. 2,330,705 to Marcia C. Hamblet describes a base adapted to receive a candle and when supporting the candle to float on water, the base comprising a lower portion, a flaring portion extending upwardly from the lower portion and defining a watertight buoyancy-giving space of width substantially greater than the diameter of the candle to be received within the base, and means for securing the lower end of the candle within said lower portion, supporting the weight of the candle and fixing unchangeably the level of the lower end of the candle with respect to all parts of the said base, the candle base being waterproof over its exterior surface, containing material of higher melting point than the temperature of melting of the wax of the candle, and having its center of gravity below the line to which the base when supporting a candle sinks in water, so that the base remains upright.

U.S. Pat. No. 2,234,903 to Thomas J. Muench describes a floating candle having an annular flange around its upper end, whereby the candle floats with its top surface initially nearly flush with the surface of the water with the wick located in the line of gravitation of the body of the candle, and the body of the candle concentric with said line, whereby the greater part of the body of the candle consumes, leaving a thin shell forming a vessel for the consuming portion of the candle body.

Notwithstanding the prior art, the present invention is neither taught nor rendered obvious thereby.

SUMMARY OF INVENTION

The present invention is directed to a floating luminary device that includes: (a.) a base saucer having at least one closed air chamber for floatation, the base saucer having a first predetermined maximum width; and, (b.) a candle mantle located on the base saucer and projecting upwardly from the base saucer and having sufficient space therein for encompassing a candle, the candle mantle having a second predetermined maximum width wherein the first predetermined maximum width is at least 10% greater than the second predetermined maximum width. In some embodiments, it may be at least 20% greater.

In some preferred embodiments of the present invention, the floating luminary device base saucer is circular from a top view. However, without exceeding the scope of the present invention, the base saucer may alternatively be oval, rectangular, triangular, polygonal, irregular, or combinations thereof.

In some preferred embodiments of the present invention, the candle mantle and the base saucer are unistructurally formed as a single component, while in others, they may be formed separately.

In some preferred embodiments of the present invention, the candle mantle is circular from a top view. However, as with the base saucer, it may have any shape footprint.

In some preferred embodiments of the present invention, the candle mantle has at least one curvilinear side.

In some preferred embodiments of the present invention, the floating luminary device base saucer and the candle mantle are separate components with each having complementary connection means.

In some preferred embodiments of the present invention, the floating luminary device complementary connection means is a turn-and-lock mechanism.

In some preferred embodiments of the present invention, the floating luminary device base saucer includes an upwardly turned peripheral portion.

In some preferred embodiments of the present invention, the floating luminary device base saucer includes at least one rim located inside the candle mantle for positioning a candle selected from the group consisting of a candle, a tea light, and a liquid fuel lamp.

In some preferred embodiments of the present invention, the floating luminary device base saucer includes at least one anchor member.

In some preferred embodiments of the present invention, the floating luminary device air chamber is located at the peripheral portion of the base saucer.

In some preferred embodiments of the present invention, the floating luminary device base saucer is fully hollow so as to create a full footprint air chamber.

In some preferred embodiments of the present invention, the floating luminary device base saucer has at least one orifice to permit water to flow into the base saucer from its underside and many include any of the features set forth in paragraphs [00014] to [00024] above.

In some preferred embodiments of the present invention, additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE EMBODIMENTS

The present invention relates generally to floating luminary devices, and, particularly, floating luminary devices that have wide base saucers containing floatation air chambers, and thus are unsinkable. They are preferably designer quality devices that safely hold one or more candles. The present invention is directed to a floating luminary device that includes: (a.) a base saucer having at least one closed air chamber for floatation, the base saucer having a first predetermined maximum width; and, (b.) a candle mantle located on the base saucer and projecting upwardly from the base saucer and having sufficient space therein for encompassing a candle, the candle mantle having a second predetermined maximum width wherein the first predetermined maximum width is at least 10% greater than the second predetermined maximum width. It could be at least 20% greater, and in some cases, as much as 50% or more greater. The device is placed in water so that it floats.

The base saucer and the candle mantle may be unilaterally constructed as a single component or separate components. When they are separate components, a complementary connection means connects the two parts. The air chamber may encompass the whole footprint of the base saucer or a portion of a peripheral end of the base saucer. The shape of the air chamber may be circular, pear shaped, approximately elliptical, or the like.

The base saucer and the mantle may be circular from a top view. The base saucer includes an upwardly turned peripheral portion. The mantle may have at least one curvilinear side. At least one light device is placed on the base saucer under the mantle, such device being a candle, a tea light or a liquid fuel lamp.

There may be optional orifices on the base saucer to permit water to flow into the base saucer from its underside. In addition, there may be an optional anchor means for anchoring the floating luminary device at a stationary location.

Figure 1:
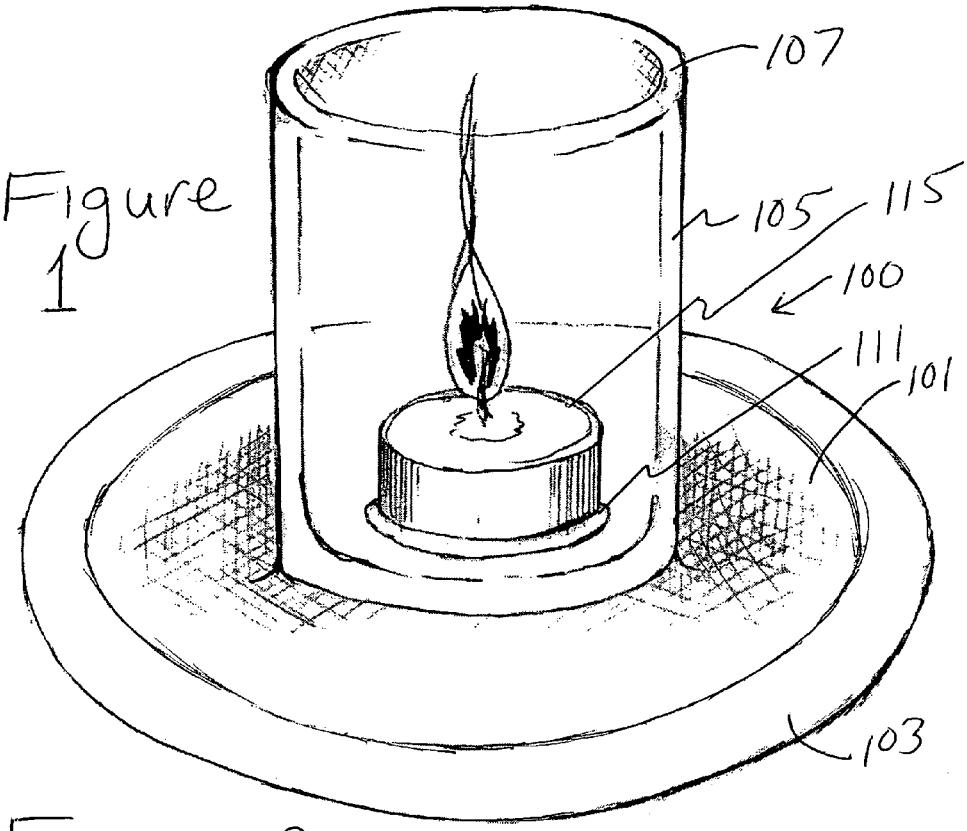
FIG. 1 illustrates a front perspective view of a preferred embodiment of a present invention floating luminary device.
Figure 2:
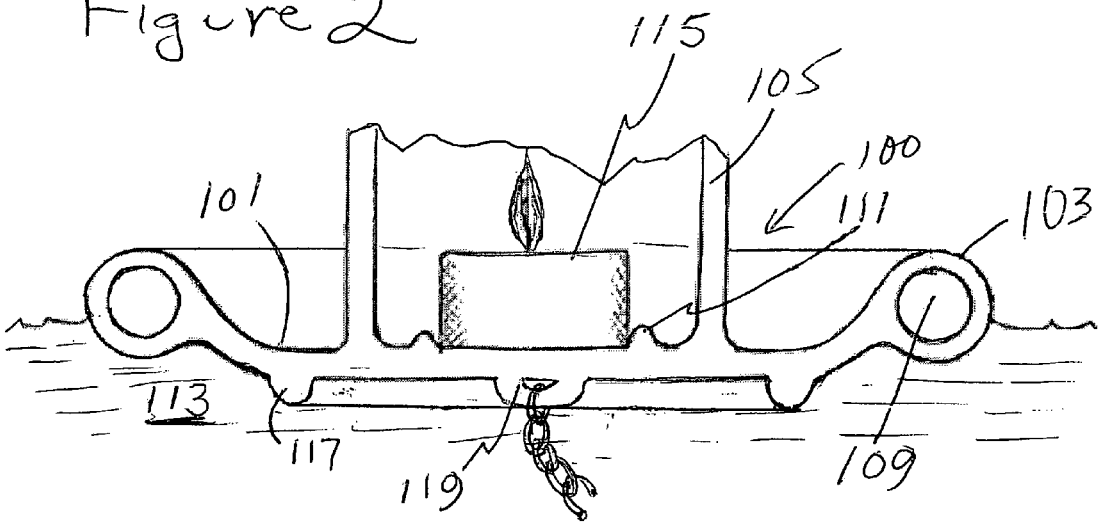
FIG. 2 shows a partial cut front view of the present invention floating luminary device shown in FIG. 1.

Referring now to FIGS. 1 and 2, there is shown a front perspective view and a partial cut front view of a present invention floating luminary device 100. The floating luminary device 100 includes a base saucer 101 having at least one closed air chamber 109 for floatation. The base saucer 101 includes a peripheral portion 103 that is upwardly turned. In addition, the base saucer 101 is circular from a top view, and has a first predetermined maximum width.

There is a candle mantle 105 located on the base saucer 101 and projecting upwardly from the base saucer 101 and having sufficient space therein for encompassing a candle. The candle mantle 105 and the base saucer 101 are unistructurally formed as a single component. The candle mantle 105 is circular from a top view and includes at least one curvilinear side 107. In addition, the candle mantle 105 has a second predetermined maximum width in which the first predetermined maximum width is at least 20% greater than the second predetermined maximum width. The peripheral portion 103 of the base saucer 101 includes an air chamber 109 for flotation. The air chamber 109 is circular and part of the base saucer 101 does not surround the air chamber 109 for flotation. There is a tea candle 115 that is held stablly in place by a protrusion rim 111. Alternatively, a candle, a liquid fuel lamp, or the like may be substituted for the tea candle 155 with an appropriately sized protrusion rim. The floating luminary device 100 is placed in water 113 so that the device floats. Downwardly extending rim 117 leaves space on the underside of base saucer 101 to enable the present invention device 100 to be placed flatly on a table or other horizontal surface while accommodating loop anchor 119. The loop anchor 119 may leave a string, chain or other flexible connection to a weight. The weight may be light enough to suspend in water and will serve only to stabilize. However, it is preferred that the flexible connection extend to near or at the bottom of the water and be connected to a sufficiently heavy weight to hold the device in the water. Thus, a present invention device may be used without or with another for either free-floating or anchored luminary effects.

Figure 3:
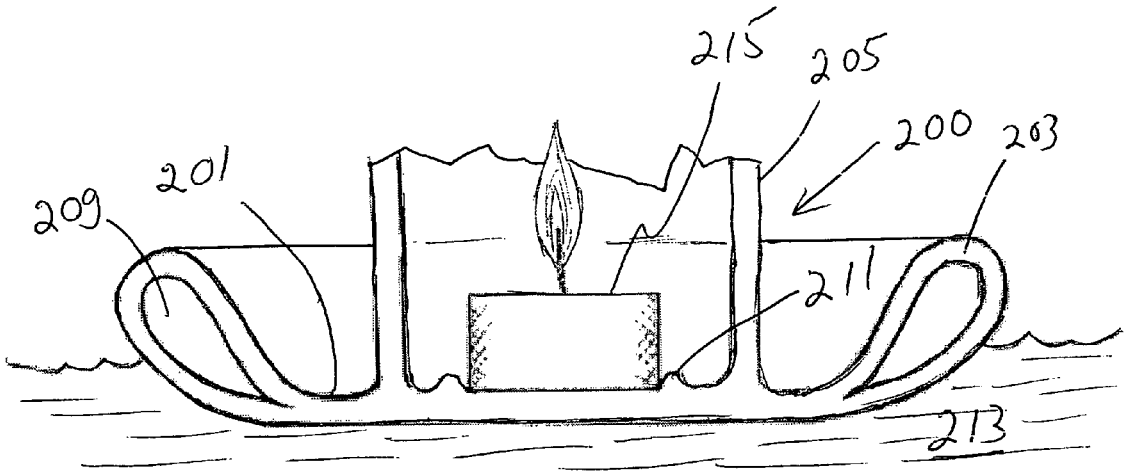
FIG. 3 illustrates a partial cut front view of another preferred embodiment present invention floating luminary device.

Referring now to FIG. 3, there is shown a partial cut front view of another embodiment of a present invention floating luminary device 200. Similar parts are numbered as in FIGS. 1 and 2, but beginning with "200". The floating luminary device 200 includes a base saucer 201 having at least one closed air chamber 209 for floatation. The base saucer 201 includes a peripheral portion 203 that is upwardly turned. In addition, the base saucer 201 is circular from a top view, and has a first predetermined maximum width.

There is a candle mantle 205 located on the base saucer 201 and projecting upwardly from the base saucer 201 and having sufficient space therein for encompassing a candle. The candle mantle 205 and the base saucer 201 are unistructurally formed as a single component. The candle mantle 205 is circular from a top view and includes at least one curvilinear side. In addition, the candle mantle 205 has a second predetermined maximum width in which the first predetermined maximum width is at least 10% greater than the second predetermined maximum width. The peripheral portion 203 of the base saucer 201 includes an air chamber 209 for flotation. The air chamber 209 is pear shaped and part of the base saucer 201 does not surround the air chamber 209. There is a tea candle 215 that is held stablly in place by a protrusion rim 211. Alternatively, a candle, a liquid fuel lamp, or the like may be substituted for the tea candle 255 with an appropriately sized protrusion rim. The floating luminary device 200 is placed in water 213 so that the device floats.

Figure 4:
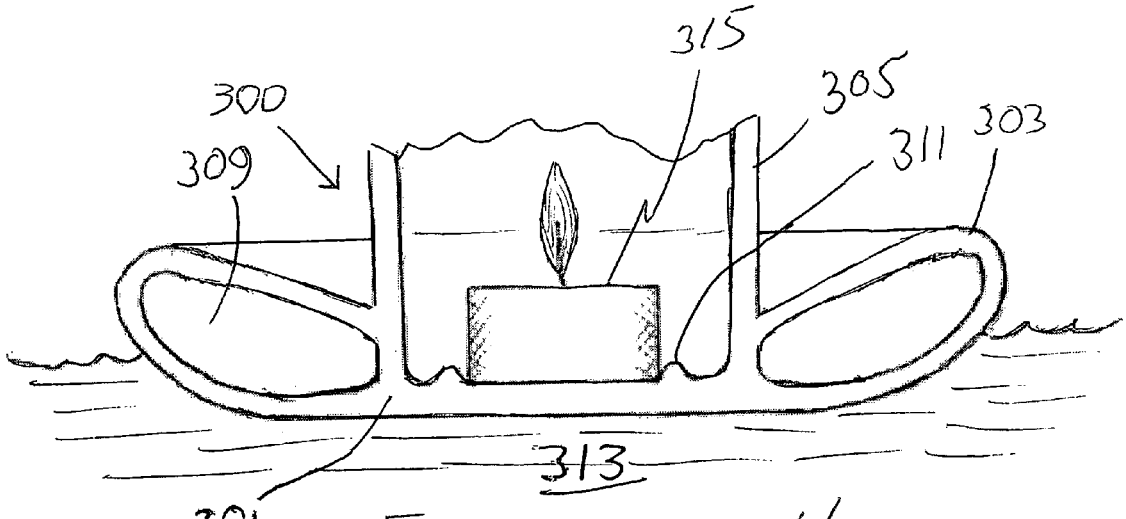
FIG. 4 illustrates a different present invention floating luminary device in a partial cut front view.

Referring now to FIG. 4, there is shown a partial cut front view of another embodiment of a present invention floating luminary device 300. Similar parts are numbered as in FIGS. 1 and 2, but beginning with "300". The floating luminary device 300 includes a base saucer 301 having at least one closed air chamber 309 for floatation. The base saucer 301 includes a peripheral portion 303 that is upwardly turned. In addition, the base saucer 301 is circular from a top view, and has a first predetermined maximum width.

There is a candle mantle 305 located on the base saucer 301 and projecting upwardly from the base saucer 301 and having sufficient space therein for encompassing a candle. The candle mantle 305 and the base saucer 301 are unistructurally formed as a single component. The candle mantle 305 is circular from a top view and includes at least one curvilinear side. In addition, the candle mantle 305 has a second predetermined maximum width in which the first predetermined maximum width is at least 10% greater than the second predetermined maximum width. The peripheral portion 303 of the base saucer 301 includes an air chamber 309 for flotation. The air chamber 309 is approximately elliptical and the air chamber 309 covers the entire base saucer 301 outside the mantle 305. There is a tea candle 315 that is held stably in place by a protrusion rim 311. Alternatively, a candle, a liquid fuel lamp, or the like may be substituted for the tea candle 355 with an appropriately sized protrusion rim. The floating luminary device 300 is placed in water 313 so that the device floats.

Figure 5:
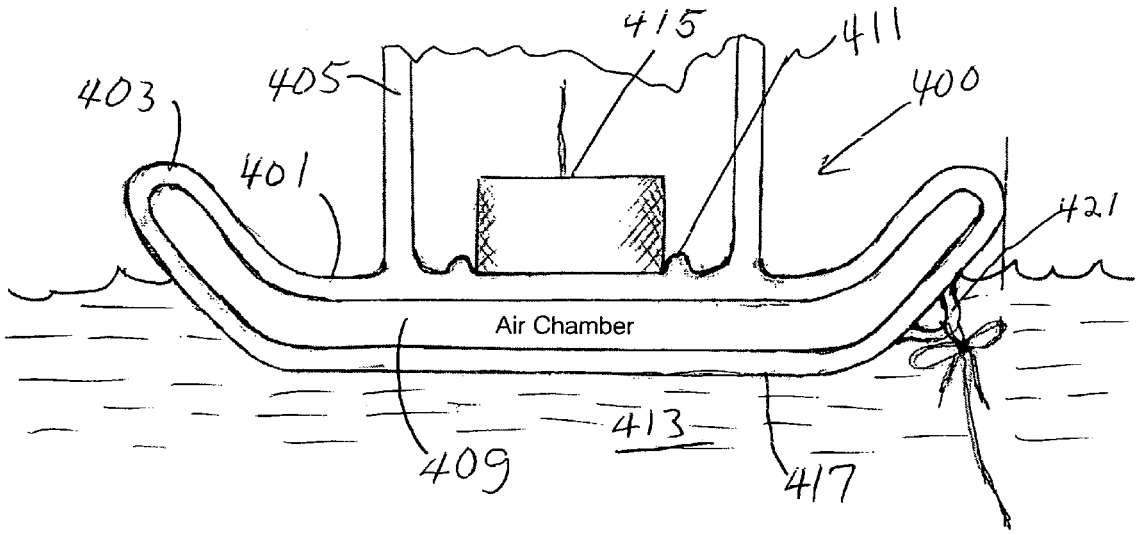
FIG. 5 illustrates a partial cut front view of another preferred embodiment present invention floating luminary device with a full footprint air chamber.

Referring now to FIG. 5, there is shown a partial cut front view of another embodiment of a present invention floating luminary device 400. Similar parts are numbered as in FIGS. 1 and 2, but beginning with "400". The floating luminary device 400 includes a base saucer 401 having at least one closed air chamber 409 for floatation. The base saucer 401 includes a peripheral portion 403 that is upwardly turned. In addition, the base saucer 401 is circular from a top view, has a first predetermined maximum width and is fully hollow.

There is a candle mantle 405 located on the base saucer 401 and projecting upwardly from the base saucer 401 and having sufficient space therein for encompassing a candle. The candle mantle 405 and the base saucer 401 are unistructurally formed as a single component. The candle mantle 405 is circular from a top view and includes at least one curvilinear side. In addition, the candle mantle 405 has a second predetermined maximum width in which the first predetermined maximum width is at least 20% greater than the second predetermined maximum width. The peripheral portion 403 of the base saucer 401 includes an air chamber 409 for flotation. The fully hollow base saucer 401 creates the air chamber 409 having a full footprint 417 of the base saucer 401. There is a tea candle 415 that is held stablly in place by a protrusion rim 411. Alternatively, a candle, a liquid fuel lamp, or the like may be substituted for the tea candle 455 with an appropriately sized protrusion rim. The floating luminary device 400 is placed in water 413 so that the device floats. In this embodiment, there is an anchor 421 for securing the floating luminary device in a stationary position.

Figure 6:
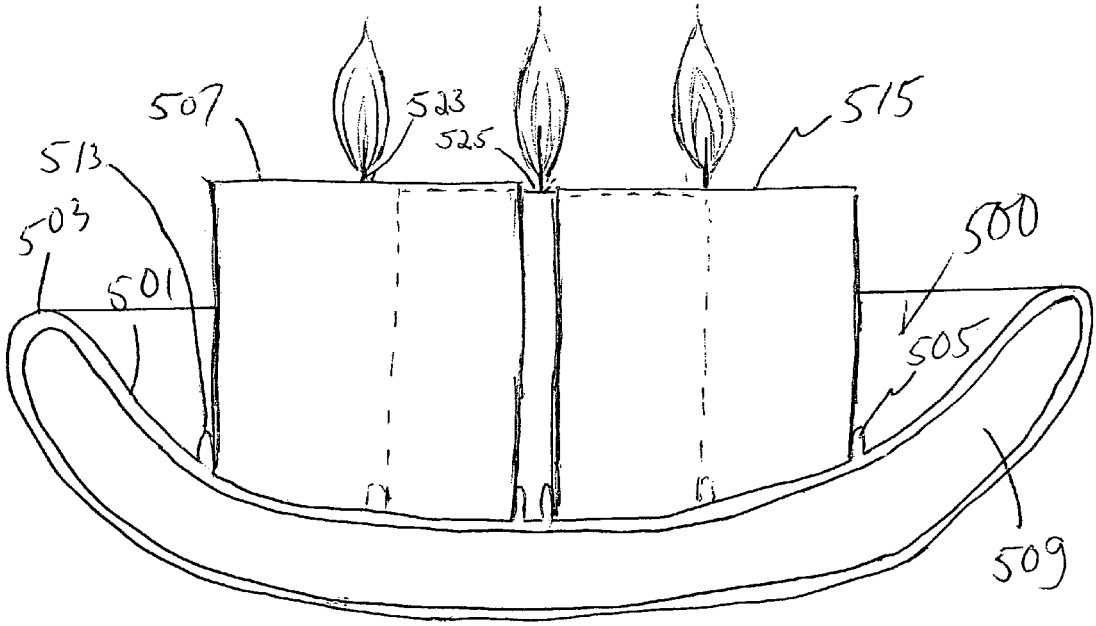
FIG. 6 illustrates a present invention floating luminary devices with plural rims for receiving a plurality of candles.

Referring now to FIG. 6, there is shown a front view of another embodiment of a present invention floating luminary device 500 having a plurality of rims for receiving a plurality of candles. Similar parts are numbered as in FIGS. 1 and 2, but beginning with "500". The floating luminary device 500 includes a base saucer 501 having at least one closed air chamber 509 for floatation. The base saucer 501 includes a peripheral portion 503 that is upwardly turned. In addition, the base saucer 501 is circular from a top view, has a first predetermined maximum width and is fully hollow.

The base saucer 501 includes a plurality of rims 505 and 513 and projecting upwardly from the base saucer 501, each rim having sufficient space therein for encompassing a candle. The peripheral portion 503 of the base saucer 501 includes an air chamber 509 for flotation. The fully hollow base saucer 501 creates the air chamber 509 having a full footprint 517 of the base saucer 501. There is a plurality of candles 515, 523 and 525 that is held stablly in place by the plurality of rims 505 and 513. The floating luminary device 500 is placed in water 513 so that the device floats.

Figure 7:
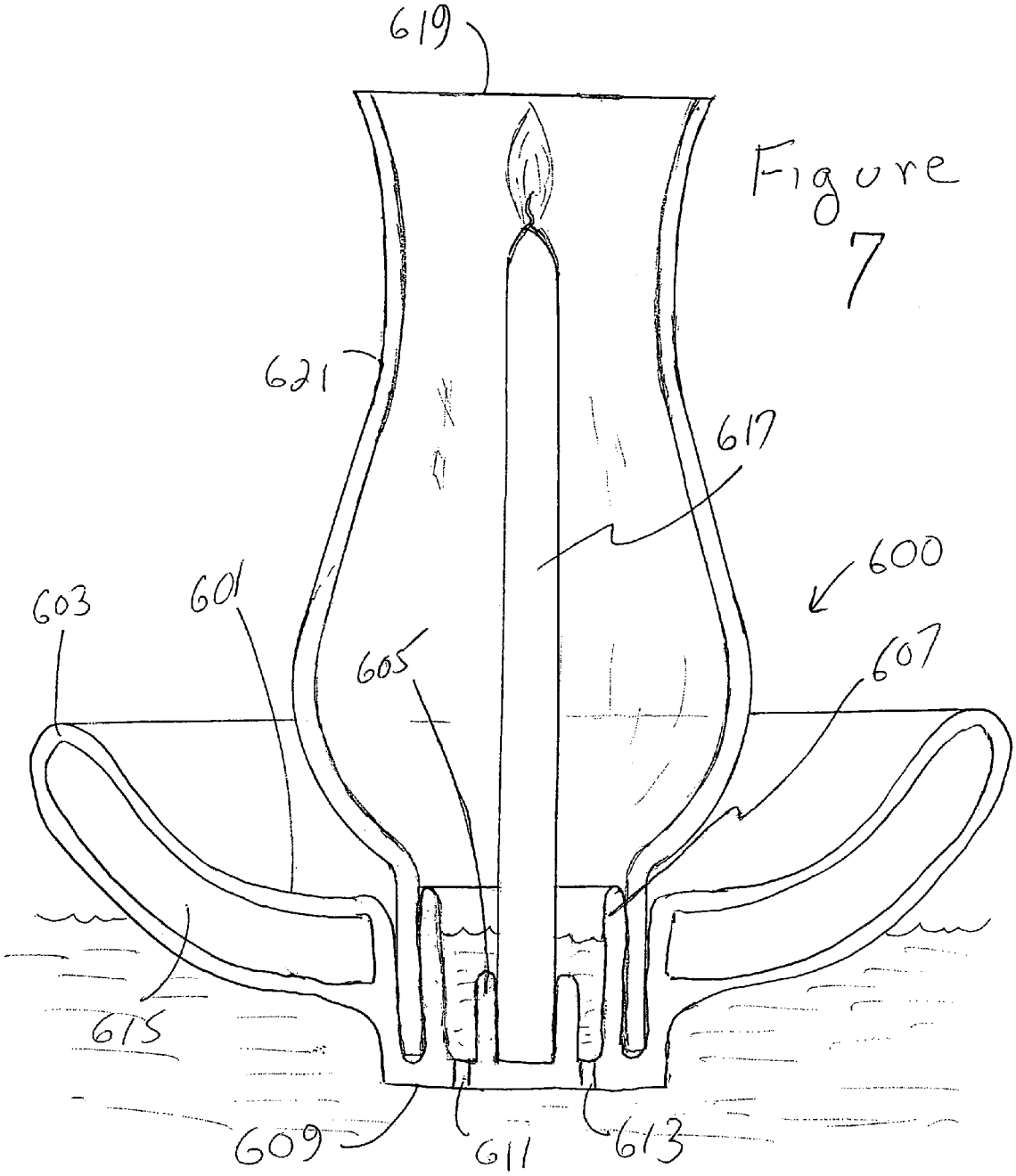
FIG. 7 shows a full cut front view of a present invention preferred embodiment floating luminary device having a separate mantle and base saucer and having inlet orifices, including a double wall for mantle nesting.

Referring now to FIG. 7, there is shown a full cut front view of another embodiment of a present invention floating luminary device 600, including a double wall 605 and 607 for mantle nesting. The floating luminary device 600 includes a base saucer 601 having at least one closed air chamber 615 for floatation. The base saucer 601 includes a peripheral portion 603 that is upwardly turned. In addition, the base saucer 601 is circular from a top view and has a first predetermined maximum width.

There is a candle mantle 621 having an open top 619 and projecting upwardly from the base saucer 601 with sufficient space therein for encompassing a candle. The candle mantle 621 and the base saucer 601 are formed as separate components in which the base saucer 601 includes a wall protrusion 607 for fitting the candle mantle 621 into a slot created between the wall protrusion 607 and a portion of the candle mantle 621. In addition, the candle mantle 621 has a second predetermined maximum width in which the first predetermined maximum width is at least 10% greater than the second predetermined maximum width. Thus, as can be seen, the wall protrusion 607 provides a secure support for the candle mantle 621.

The peripheral portion 603 of the base saucer 601 includes an air chamber 615 for flotation. There is a candle 617 that is held stablly in place by a protrusion rim 605. The floating luminary device 600 is placed in water so that the device floats. In this embodiment, there is at least one orifice 611, 613 to permit water to flow into the base saucer 601 from its underside. The water acts both as a weight for floatation stability and, in some preferred embodiments, as a self-extinguishing mechanism for the candle.

Figure 8:
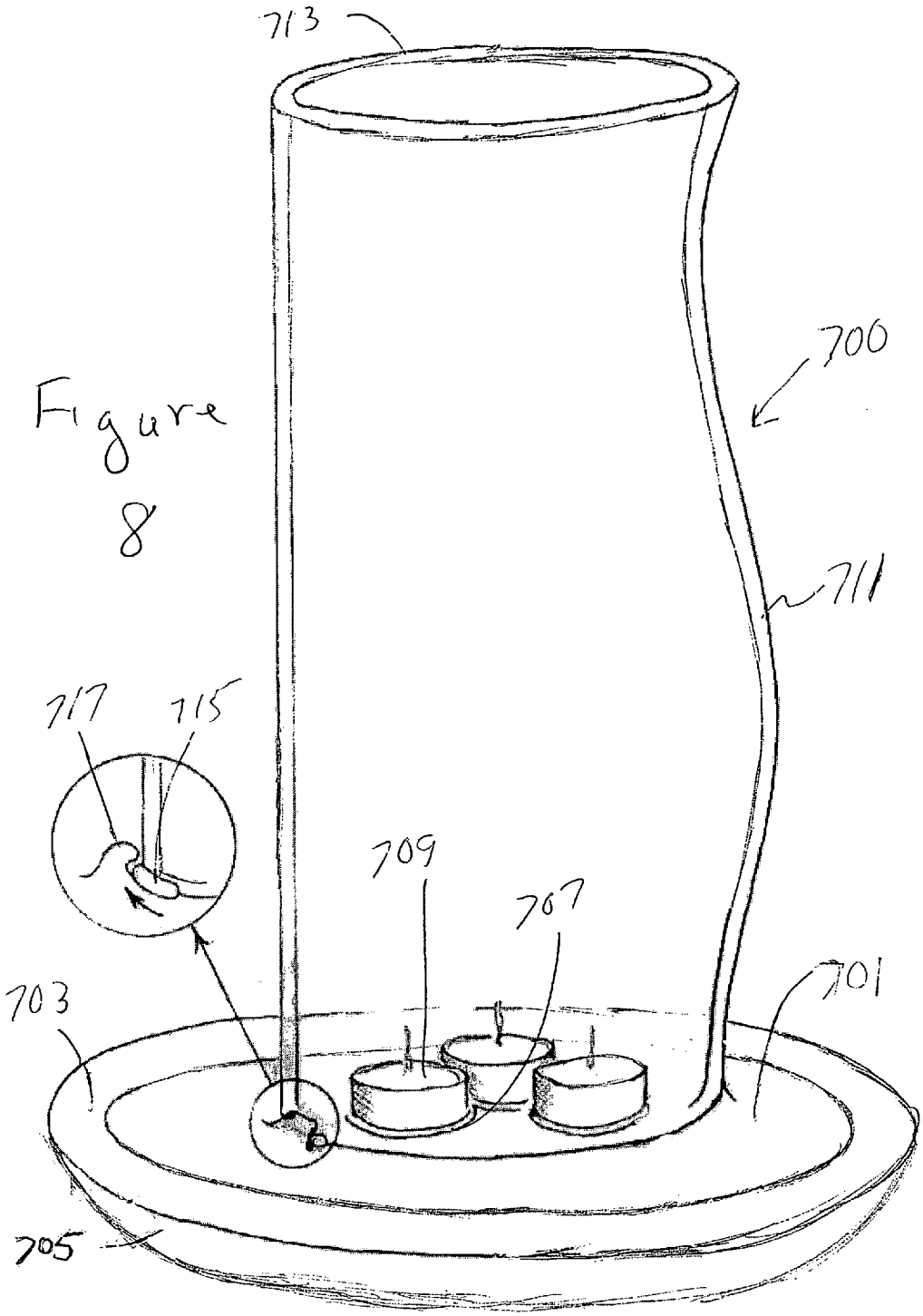
FIG. 8 is a front perspective view of another present invention for multiple candles; and, FIG. 9 shows a full cut front view of a present invention preferred embodiment floating luminary device having a separate mantle and base saucer and having inlet orifices, including an outside nesting wall for receiving the mantle.

Referring now to FIG. 8, there is shown a front perspective view of another embodiment of a present invention floating luminary device 700. The floating luminary device 700 includes a base saucer 701 having at least one closed air chamber 705 for floatation. The base saucer 701 includes a peripheral portion 703 that is upwardly turned. In addition, the base saucer 701 is circular from a top view and has a first predetermined maximum width.

There is a candle mantle 711 having an open top 713 and projecting upwardly from the base saucer 701 with sufficient space therein for encompassing a candle. The candle mantle 711 and the base saucer 701 are formed as separate components in which the base saucer 701 includes at least one rim 707 for fitting the candle mantle 711. In addition, the candle mantle 711 has a second predetermined maximum width in which the first predetermined maximum width is at least 10% greater than the second predetermined maximum width.

The peripheral portion 703 of the base saucer 701 includes the air chamber 705 for flotation. There is at least one candle 709 that is held stablly in place by a rim 707. The floating luminary device 700 is placed in water so that the device floats. In this embodiment, the base saucer 701 and the candle mantle 711 are separately formed and are connected by connection means. In this case, connection means is a hook 717 on the base saucer 701 which mates with a corresponding turning and locking fitting 715 attached to the candle mantle 711.

Figure 9:
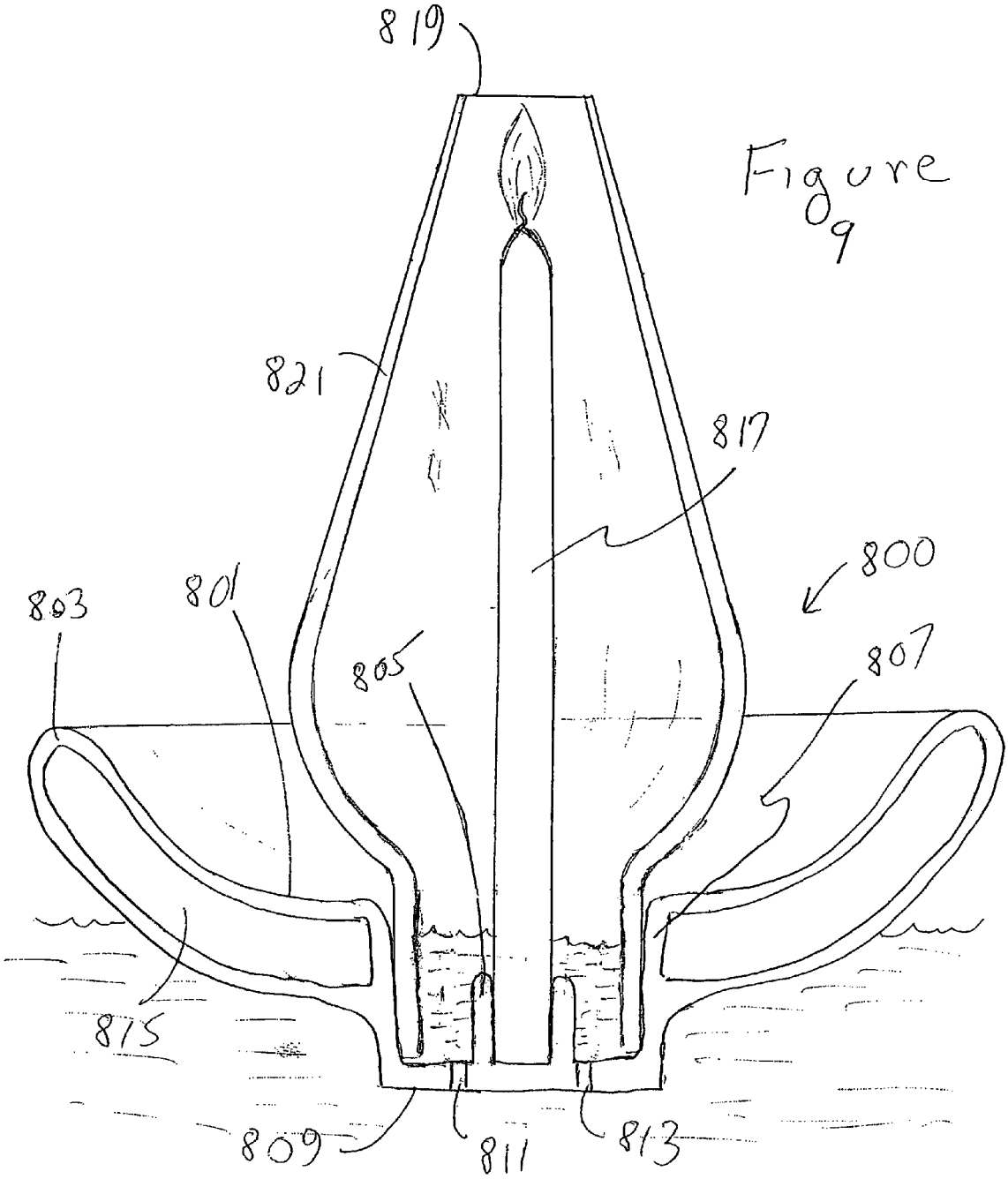

Referring now to FIG. 9, there is shown a full cut front view of another embodiment of a present invention floating luminary device 800, including an outside nesting wall 607 for receiving a mantle 821. The floating luminary device 800 includes a base saucer 801 having at least one closed air chamber 815 for floatation. The base saucer 801 includes a peripheral portion 803 that is upwardly turned. In addition, the base saucer 801 is circular from a top view and has a first predetermined maximum width.

There is the candle mantle 821 having an open top 819 and projecting upwardly from the base saucer 801 with sufficient space therein for encompassing a candle. The candle mantle 821 and the base saucer 801 are formed as separate components in which the base saucer 801 includes the outside nesting wall 807 for securing the candle mantle 821 in place adjacent to the outside nesting wall 807. In addition, the candle mantle 821 has a second predetermined maximum width in which the second predetermined maximum width is at least 10% greater than the first predetermined maximum width.

The peripheral portion 803 of the base saucer 801 includes an air chamber 815 for flotation. There is a candle 817 that is held stablly in place by a protrusion rim 805. The floating luminary device 800 is placed in water so that the device floats. In this embodiment, there is at least one orifice 811, 813 to permit water to flow into the base saucer 801 from its underside.

To summarize, the present invention thus provides a floating luminary device having a base saucer and a candle mantle. The base saucer includes an air chamber for flotation which may expand a portion of the base saucer or the entire footprint. The device holds at least one candle.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A floating luminary device which comprises:

(a) a base saucer having at least one closed air chamber for floatation, said base saucer having a first predetermined maximum width; and, (b) a candle mantle located on said base saucer and projecting upwardly from said base saucer and having sufficient space therein for encompassing a candle, said candle mantle having a second predetermined maximum width wherein said first predetermined maximum width is at least 10% greater than said second predetermined maximum width; wherein said candle mantle and said base saucer are unistructurally formed as a single component.

2. The floating luminary device of claim 1 wherein said base saucer is circular from a top view.

3. The floating luminary device of claim 1 wherein said candle mantle is circular from a top view.

4. The floating luminary device of claim 1 wherein said candle mantle has at least one curvilinear side.

5. The floating luminary device of claim 1 wherein said base saucer includes an upwardly turned peripheral portion.

6. The floating luminary device of claim 1 wherein said base saucer includes at least one rim located inside said candle mantle for positioning a candle selected from the group consisting of a candle, a tea light, and a liquid fuel lamp.

7. The floating luminary device of claim 1 wherein said base saucer includes at least one anchor member.

8. The floating luminary device of claim 1 wherein said air chamber is located at a peripheral portion of said base saucer.

9. The floating luminary device of claim 1 wherein said base saucer is fully hollow so as to create a full footprint air chamber.

10. The floating luminary device of claim 1 wherein said base saucer has at least one orifice to permit water to flow into said base saucer from its underside.

11. A floating luminary device which comprises:

(a) a base saucer having at least one closed air chamber for floatation, said base saucer having a first predetermined maximum width; and, (b) a candle mantle located on said base saucer and projecting upwardly from said base saucer and having sufficient space therein for encompassing a candle, said candle mantle having a second predetermined maximum width wherein said first predetermined maximum width is at least 10% greater than said second predetermined maximum width; wherein said base saucer and said candle mantle are separate components with each having complementary connection means, and said complementary connection means is a turn-and-lock mechanism.

12. The floating luminary device of claim 11 wherein said base saucer is circular from a top view.

13. The floating luminary device of claim 11 wherein said candle mantle is circular from a top view.

14. The floating luminary device of claim 11 wherein said candle mantle has at least one curvilinear side.

15. The floating luminary device of claim 11 wherein said base saucer includes an upwardly turned peripheral portion.

16. The floating luminary device of claim 11 wherein said base saucer includes at least one rim located inside said candle mantle for positioning a candle selected from the group consisting of a candle, a tea light, and a liquid fuel lamp.

17. The floating luminary device of claim 11 wherein said base saucer includes at least one anchor member.

18. The floating luminary device of claim 11 wherein said air chamber is located at a peripheral portion of said base saucer.

19. The floating luminary device of claim 11 wherein said base saucer is fully hollow so as to create a full footprint air chamber.

20. The floating luminary device of claim 11 wherein said base saucer has at least one orifice to permit water to flow into said base saucer from its underside.

* * * * *